United States Patent [19]

Spitzer

[11] 4,036,714

[45] July 19, 1977

[54] ELECTROLYTIC CELLS AND PROCESSES

[75] Inventor: Robert Spitzer, New York, N.Y.

[73] Assignee: E. I. Du Pont de Nemours and Company, Inc., Wilmington, Del.

[21] Appl. No.: 543,912

[22] Filed: Jan. 24, 1975

Related U.S. Application Data

[62] Division of Ser. No. 298,922, Oct. 19, 1972, Pat. No. 3,864,226.

[51] Int. Cl.[2] ..... C25B 1/16; C25B 1/26; C25B 1/02; C25B 1/22

[52] U.S. Cl. ..... 204/99; 204/98; 204/128; 204/129; 204/251; 204/266; 204/104

[58] Field of Search ..... 204/251, 99, 98, 128, 204/104, 129, 256, 258, 266

[56] References Cited

U.S. PATENT DOCUMENTS

| | | | |
|---|---|---|---|
| 1,109,311 | 9/1914 | Allen | 204/251 |
| 2,681,320 | 6/1954 | Bodamer | 204/98 |
| 2,749,301 | 6/1956 | Rosenbloom | 204/251 |
| 3,282,875 | 11/1966 | Connolly et al. | 204/296 |
| 3,770,611 | 11/1973 | Barnabe | 204/98 |
| 3,773,634 | 11/1973 | Stacey et al. | 204/98 |
| 3,901,774 | 8/1975 | Motani et al. | 204/258 |

OTHER PUBLICATIONS

"X. R. Perfluorosulfonic Acid Membranes–New Product Information" E. I. DuPont de Nemours & Co., 10-1-69.

*Primary Examiner*—R. L. Andrews

[57] ABSTRACT

A method and apparatus for the electrolysis of an aqueous solution containing alkali metal ions, for example, the electrolysis of brine to produce chlorine and caustic. In one embodiment, a composite membrane comprising at least an ion-conductive polymer and a metal permeable to alkali metal is used in an electrolytic cell. An illustration of such a polymer is a perfluorocarbon polymer containing sulfonic acid or sulfonate groups, in intimate contact with a layer of mercury. Another aspect is the use of elevated pressures or other techniques substantially to eliminate the presence of normally gaseous products from the electrolyte. For example, high pressures may be employed to dissolve chlorine in a brine electrolyte and/or liquefy it. In another aspect, sodium sulfate is electrolyzed in a cell comprising a composite membrane, a formaminous anode, and a diaphragm between the composite membrane and anode; the oxygen produced is withdrawn through the anode.

25 Claims, 7 Drawing Figures

ELECTROLYTIC CELLS AND PROCESSES

This is a division of application Ser. No. 298,922, filed Oct. 19, 1972, now U.S. Pat. No. 3,864,226.

BACKGROUND

Several industrial processes are based on the electrolysis of aqueous salt solutions. One important application is that of the electrolysis of sodium chloride brine to produce sodium hydroxide and chlorine. In this electrolysis, as in others involving electrolysis of aqueous salt solutions, one method is to separate the anolyte and the catholyte compartments of the cell using a porous separator. Hereinafter the term "diaphragm" will be used for a porous separator which permits electrolyte to pass through without any significant change in composition.

In this method hydrogen and caustic soda are produced at the cathode which is within the catholyte compartment of the cell while chlorine is produced at the anode which is within the anoltye compartment. The salt brine passes through the diaphragm from the anolyte to the catholyte compartment. The cathodes are usually of iron screening while the anodes are of graphite or platinized titanium. The diaphragm is usually aspestos.

Diaphragm cells require a flow of solution sufficient to insure that the back-diffusion of sodium hydroxide into the anolyte is avoided or minimized. This is necessary to avoid chlorate in the anolyte and loss of current efficiency. When using the minimum amount of brine flow within the diaphragm to avoid chlorate formation, only about half of the sodium chloride is converted. The spent anolyte must then be evaporated to concentrate the caustic soda and to crystallize the salt. Finally the salt is filtered or centrifuged from the caustic solution. It is the usual practice to purify the brine feed to the process to reduce the content of impurities which clog the diaphragms; also it is usual to renew the duaphragms at regular intervals.

Attempts have been made to build diaphragm cells using permselective membranes in place of the diaphragms. This does not provide a solution to the principal problem. All of the membranes which offer reasonably high electrical conductivity and chemical resistance are also subject to considerable back-diffusion and electromigration of hydroxyl ions, the rate of which increases with the concentration and temperature of the catholyte.

A second type of cell for chlorine and caustic soda production is the mercury cell in which electrolysis of the brine results in production of a sodium amalgam at the cathode and chlorine at the anode. The amalgam is reacted with water, producing a salt-free solution of caustic soda together with hydrogen. In this method a diaphragm is not required because caustic soda solution is formed in a separate piece of apparatus or compartment from the one containing brine solution and chlorine.

In one embodiment of a mercury cell, purified sodium chloride brine is fed into a slightly sloped horizontal trough on the bottom of which the cathode mercury flows concurrently with the brine. Above the mercury and within the brine are horizontal anodes of graphite or platinum-, or platinum family-coated titanium. These anodes are suspended from gas tight covers of the trough. Current is supplied to the anodes by rods suspended from, and sealed in, holes in these covers.

The brine is confined within the trough by mercury syphons at the ends of the trough. Typically the concentration in the cell is reduced from 315 to 275 g l NaCl and the brine leaves the trough by an overflow. Conventionally, it is fed to the trough by a valve and rotameter. After leaving the cell, the brine is dechlorinated by a combination of HCl addition and vacuum and air stripping, resaturated, purified and returned to the cell with its pH at about 7.0.

Electricity is led into the mercury by connections to the steel trough bottoms with bus-work. Anode rods that project above the cover, and usually have to be vertically adjustable, are connected to the main bus-work by pigtails, clamps, soldered rods or similar hardware. To stop operation of each trough, short circuit switches that connect the anode bus-work to the cathode buswork are usually provided.

The covers, sidewalls, end boxes, seals and, at times, most ot the bottom of the trough are covered with corrosion resistant material, usually hard rubber. The life, before repair or replacement becomes necessary, hardly ever exceeds five years and is often much less. This assemblage of components is commonly called the primary cell.

The mercury flowing out of the primary cell contains sodium, plus impurities such as calcium, magnesium and iron that may not have been fully removed in the prepurification of the brine. To remove the sodium, thus making caustic soda, the mercury is washed with distilled water. This operation is performed in contact with graphite, leading to the production of caustic solution, hydrogen gas and relatively sodium-free mercury, which is pumped back to the inlet box of the primary cell. The apparatus for this is conventionally called the secondary cell or denuder. In present practice, it is either a horizontal trough with graphite grids, or a short tower with graphite packing. If it is a trough, it is arranged either alongside or under the primary cell; if it is a tower it is usually arranged on the discharge end of the primary cell, with the pump underneath the tower and a long pipe under the primary cell that conducts the mercury back.

To understand the function of the mercury cathode in a mercury chlorine-caustic cell, consider the electrolysis of a sodium chloride solution between a steel cathode and a graphite anode. Chlorine is evolved at the anode and hydrogen at the cathode, while caustic soda is formed simultaneously at the latter. according to the reaction:

$$2NaCl + 2H_2O = 2NaOH + Cl_2 + H_2$$

With no separation of the anolyte and cathode, the following secondary reactions occur:

$$2NaOH + Cl_2 = NaCl + H_2O$$
$$3\ NaOCl = NaClO_3 + 2NaCl$$
$$C\ (Graphite) + 2NaOCL = 2NaCl + CO_2$$
$$Cl_2 + H_2 = 2HCl\ (Explosion)$$

Obviously such a cell does not serve the purpose of producing caustic soda and chlorine. On the other hand in a mercury cell, and utilizing a mercury cathode, if the mercury is relatively pure, hydrogen will not be evolved on the cathode preferentially to the discharge of sodium, and the mercury will become sodium amalgam, in accordance with the following:

$$2NaCl \rightarrow 2Na(Hg) + Cl_2$$

because the hydrogen overvoltage on a mercury surface is higher than the voltage required to deposit sodium into such a surface. The overvoltage is the voltage of an electrode above that theoretically required to discharge a gas on its surface.

If the mercury contains more than a few tenths of one percent of sodium, or traces of magnesium, nickel or similarly low hydrogen overvoltage metals, hydrogen and caustic soda rather than sodium amalgen will form to a greater or lesser extent. When this happens, the current efficiency drops, graphite consumption increases and the chlorine gas in the cell, or in the uncondensable gas left after most of the chlorine is liquefied, becomes explosive because of hydrogen admixture.

The reverse effect is desired when making caustic and hydrogen from amalgam. If clean sodium amalgam is placed in a beaker and water or caustic is poured over it, little or no reason takes place, because hydrogen does not readily discharge from a mercury surface. If a piece of graphite is partly dipped into the mercury, hydrogen bubbles can be observed rising from the graphite very near the mercury surface, the water or caustic become more alkaline and the amalgam is denuded of its sodium. Thus, under operating conditions the denuder is a short-circuited battery in which the amalgam is the anode and the graphite the cathode.

The process produces a pure concentrated caustic, normally about 50%, compared to about 11% concentration for the diaphgram cell. However, the circulation of mercury, the exposure of the mercury surface to salt brine where it is always denuded to a greater or lesser extent, and other problems inherent in the technology have always forced the design into large, expensive, complicated equipment occupying large buildings and leading to inevitable mercury pollution from skimming operations and the like. Furthermore, mercury cells are extremely sensitive to impurities in the sodium chloride solution as these increase the denuding of the amalgam that takes place during electrolysis, resulting in a high and frequency explosive hydrogen content of the chlorine.

The problems of circulation of mercury may be avoided if the configuration is one in which the mercury is used as a membrane, one face of which is the cathode in the brine which undergoes electrolysis, the other face of which is in contact with the caustic soda solution. In this manner the deposition of sodium in the amalgam occurs simultaneously with denuding at the opposite face.

Attempts to achieve this have invariably led to a design wherein the mercury is either supported in syphon-like superimposed channels or on porous or woven materials, essentially on a diaphragm. When the mercury is supported in syphons, the long path that the sodium metal must travel through the mercury results in overconcentration of sodium at the cathode surface accompanied by hydrogen evolution on the cathode surface and into the chlorine and, if the mercury is supported on a diaphragm, the eventual result has always been that the resistance increase because gas bubbles become entangled in the pores. Furthermore, deposition of metallic impurities such as iron in the pores results in wetting of these impurities by mercury accompanined by mercury leaking through the diaphragm and being lost.

A variation in the mercury cathode cell is disclosed in U.S. Pat. No. 2,749,301. The mercury cathode is supported on a porous diaphragm of a woven plastic fabric or asbestos cloth. The brine flows beneath the cathode on the anode surface. A very large, and thus uneconomical, flow of brine must be pumped through the space between the anode and the diaphragm to avoid the blanketing of the diaphragm by gas bubbles. However, even with a high flow rate, bubbles of chlorine as well as hydrogen from the mercury layer above the diaphragm slowly become entangled in the diaphragm and reduce the efficiency of the process.

An object of the present invention is to provide novel processes and apparatus for the electrolysis of alkali metal solutions. It is also an object of this invention to overcome certain deficiencies which exists in presently used electrolysis cells and processes.

These and other objects will be set forth more fully in the following detailed description.

THE INVENTION

This invention is directed to processes and apparatus for the electrolysis of aqueous solutions containing alkali metal ions, as illustrated by the electrolysis of sodium chlorine solution to form chlorine, sodium hydroxide and hydrogen. The alkali metal ions will be in solution with anions of the mineral acids, and or hydroxyl ion, and or anions of organic acids. Examples of such aqueous solutions are solutions of the chlorides, bromides, sulfates, sulfites, phosphates, acetates and hydroxides of sodium and potassium.

In one embodiment of the invention a composite membrane is used to separate the cathode products from the electrolyte. The composite membrane is characterized by a membrane (which is a solid polymer or resin) facing the anode, and a layer of metal permeable to alkali metal in intimate contact with the membrane. The term membrane is used for a material which exhibits high ion permeability, and relatively low permeability with respect to the anolyte. In a further aspect of this invention the presence of a gas phase in the electrolyte adjacent to the composite membrane is avoided, either by operation above atmospheric pressure under conditions wherein normally produced gaseous products are liquefied or dissolved in the electrolyte, or by operation with the anode covered with an electrolyte-permeable diaphragm or an anionpermeable membrane and with removal of the anode products through the anode. In still another aspect of this invention, cell modules, consisting of electrolytic and denuding compartments separated by composite membranes are stacked to provide distributed series flow of electrical current from cell to cell, while fluids flow uniformly to and from the cell modules within electrically nonconducting channels, tubing or piping.

It is characteristic of the composite membrane that in its application to the electrolysis of an aqueous alkali salt solution, alkali metal ions migrate from the aqueous solution through the membrane into the layer of metal and then pass out of the metal layer.

For the most advantageous utilization of this invention it is obvious that the electrical resistance to the electromigration of alkali metal ions within the membrane should be low and that the transport capacity of the metal layer for the alkali metal should be high to provide the maximum unit capacity for the composite membrane and the minimum requirement of electrical energy. Furthermore, the composite membrane is designed to provide direct interfacial contact between the polymeric membrane and the metallic layer in order that the alkali metal ions may be discharged directly from the polymeric membrane into the metallic layer to be conducted therethrough as alkali metal atoms, or as alkali metal ions together with free electrons.

A preferred metallic layer is liquid mercury which forms liquid amalgams with the alkali metals. This characteristic is, of course, well known in the prior art in which mercury cells are widely used for the production of electrolytic chlorine and caustic soda. In the following description mercury will be used in referring to the metal layer of the composite membrane of this invention.

In a further embodiment of this invention the interface between the polymeric membrane and the mercury layer can be increased above that of a planar interface by corrugating or dimpling the membrane into the mercury layer. It is advantagous also to effect an extension of this interface by depositing mercury within the polymeric membrane structure, for example, by an initial electrolysis of a mercury salt solution or by otherwise depositing mercury within the membrane structure. It has also been found that resistance can be decreased by applying a swelling agent, usually a polar solvent such as ethanol or glycol, to the polymeric meric membrane either along or in combination with the mercury impregnant.

The polymeric portion of the composite membrane should have the characteristics of low electrical resistivity and high chemical resistance to chlorine and brine under the operating condition employed.

The polymeric portion of the composite membrane may comprise a solid perfluorocarbon polymer having pendant sulfonic acid or sulfonate groups, or sulfonic acid and sulfonate groups. (The term "sulfonic groups" is used to refer generically to the sulfnic acid and or sulfonate groups.) Said perfluorocarbon polymer has the pendant groups attached either directly to the main polymer chain or to perfluorocarbon side chains attached to the main polymer chain. Either or both the main polymer chains and any side chain may contain oxygen atom linkages (i.e. ether linkages). The perfluorocarbon polymer from which the polymeric portion of the composite membrane of the invention is prepared includes perfluorocarbon copolymers with said pendant groups as well as perfluorocarbon polymers having mixed chlorine and fluorine substituents where the number of chlorine atoms is not more than about 25% of the total chlorine and fluorine atoms, with said pendant groups. The polymeric portion may optionally be reinforced, for example, by using a screen of a suitable metal or a cloth of polytetrafluoroethylene or other reinforcing material as disclosed in copending application Ser. No. 196,772. The perfluorocarbon polymers used for the membrane portion of the composite membrane may be prepared as disclosed in U.S. Pat. Nos. 3,041,317; 3,282,875 and 3,624,053.

The preferred perfluorocarbon polymers are prepared by copolymerizing a vinyl ether having the formula $FSO_2CF_2CF_2OCF(CF_3)CF_2OCF=CF_2$ and tetrafluoroethylene followed by converting the $-SO_2F$ group to either $-SO_3H$ or sulfonate (for example alkali metal sulfonates) or both. The equivalent weight of the preferred copolymers range from 950 to 1350 where equivalent weight is defined as the average molecular weight per sulfonyl group. The preferred thickness of the membrane portion is 0.001 to 0.010 inch.

Thus the cells of this invention have an anode and a composite membrane comprising a polymeric portion comprising perfluorocarbon polymers having pendant sulfonic acid and or sulfonate groups and a cathodic layer of metal permeable to alkali metal ions in intimate contact with said polymeric portion.

Although the metal layer of the composite membrane has been described as mercury, other metals may be used in its place. The nature of the metal chosen depends upon the cation of the electrolyte, the permeability of the metal laer to the cation, and the interaction of the metal layer with the cation. For example, thin films of silver and/or lead or combinations of these metals with mercury could be considered for this purpose. Since the electrolytic cell of the present invention is operable under high pressures and elevated temperatures, normally solid metals and alloys can be used in their molten state. A very thin layer of a solid metal which exhibits sodium diffusion characteristics would permit the use of a solid metallic component in the composite membrane. This technique could also be used in combination with a liquid metal. These and other embodiments would facilitate a configuration in which the composite membrane is used in a position other than horizontal.

The anodes of the electrolytic cell can be made of any material that is suitable for the electrolytic process intended, such as the platinum group metals and their oxides either alone or as a coating over titanium or tantalum. The anode may be of any suitable configuration such as sheets, expanded or perforated metal, smaller segments of such forms, or other configuration that does not lead to damming or entrapment of the anode product.

The short-circuited electrodes in the denuding compartments consist of graphite or similar material having a relatively low hydrogen overvoltage. These electrodes are distributed in a pattern over the surface of the mercury in the denuding compartments and are partly immersed in the mercury. Bubbles of hydrogen gas are evolved at the graphite surface, while hydroxyl ions are formed as sodium ions enter the aqueous solution from the mercury layer.

The short-circuited graphite electrodes may serve also carry the cathodic current to the mercury, but it is preferable to use metallic leads from the anode of the cell next above. It has been found that graphite fabric intertwined between and around these metallic leads is effective in causing a rapid and thorough denuding of the amalgam, while permitting a close spacing of the metallic leads.

The invention will be described in greater detail in conjunction with the accompanying diagrammatic representations. It should be understood that the means of carrying out the inventions exemplified by the figures are not limiting and that various modifications of constructive and operational detail could be used by a person skilled in the art.

FIGS. 1, 2, 3 and 4 are directed to a cell stack within which the individual elements occupy an essentially annular space with the feed of electrolyte and water coming from outside the annulus while the cylindrical core at the center of the annulus is used for insulating conduits for spent electrolyte. Other geometrical forms, such as rectangular elements, can also be employed. For each of FIGS. 1, 2 and 3 reference is made in the following description to the top portion of the cell which is identical to the top portion of next adjacent lower cell, as shown in the figures.

Figure 1:
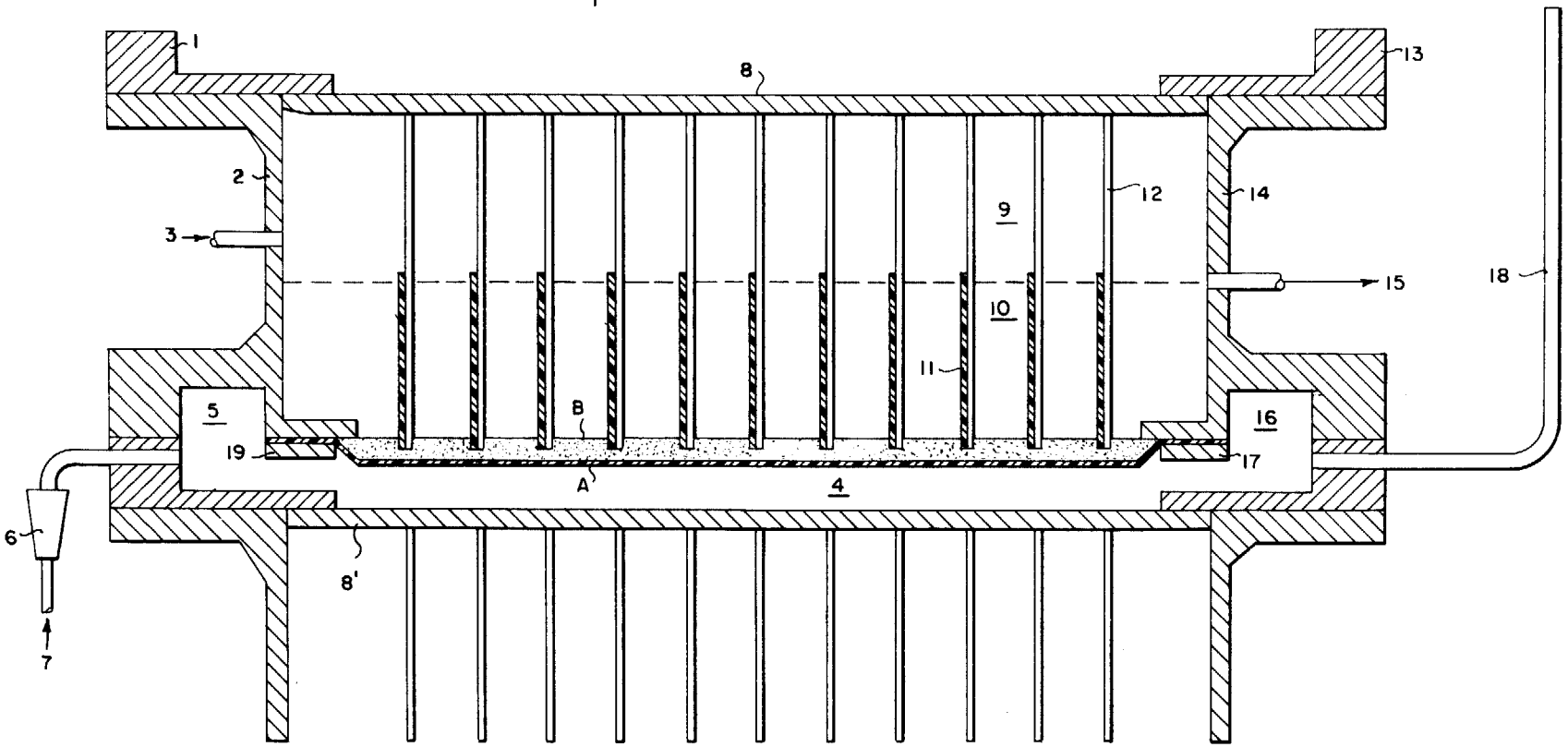
FIG. 1 is a partial section of a single element of a cell using a composite membrane, a sheet type anode and graphite fabric in the denuder, intended to produce chlorine under pressure as a dissolved gas.

Referring to FIG. 1, 1 is the outer anode ring, 2 is the outer denuder shell, 3 is the water feed pipe, 4 is the anolyte, 5 is the outer anolyte bustle, 6 is the anolyte regulator, 7 is the anolyte feed pipe, 8 is the anode, 9 is the hydrogen space, 10 is the caustic space, 11 is the graphite fabric tape, 12 is a current lead, 13 is the inner anode ring, 14 is the inner denuder shell, 15 is the caustic and hydrogen outlet pipe, 16 is the inner anolyte bustle, 17 is the inner membrane ring, 18 is the anolyte overflow pipe, and 19 is the outer membrane ring. The layers A and B together form the composite membrane; wherein A is the polymeric membrane layer and B is the metal layer, namely mercury.

The electrolytic element is confined by the anode 8, the outer anode ring 1, the inner anode ring 13, the outer denuder shell 2, the inner denuder shell 14, and the bottom of the next anode 8'. Within the elements are the composite membrane AB, the graphite tape 11, and the current leads 12.

The anode 8 is a plate that can be made of steel or nickel with a thin layer of titanium bonded in intimate electrical contact to its upper surface. The upper surface of this titanium layer would, in turn, be coated with a member of the platinum metal family or one of their oxides, such as ruthenium oxide. On the under side of the anode are attached the leads 12. This attachment must again be in intimate electrical contact. For instance, the leads 12 can be nickel wires attached to the anode plate by electron beam welding. These leads are not necessarily straight wires but could be hair pin loops or any other suitable configuration that will conduct current between the mercury and the anode next above and make good electrical contact between them without tending to blanket the space between the mercury surface or the interface between the mercury B and the membrane A. One skilled in the art can, of course, calculate the electrical conductivity of these elements. A very good distribution of the current in the mercury is necessary. Whether this is accomplished by a large multiplicity of thin leads or by fewer thicker leads equipped with thinner distribution leads within the mercury, such as a screen, is not important as long as the basic requirements listed above are met.

The elements in contact with anolyte and chlorine, the anode rings 1 and 13 and the lower portions of the denuder rings 2 and 14, the membrane rings 17 and 19 and the requisite gaskets that are not shown for the sake of simplicity must be of such material and construction as will withstand the corrosive environment encountered. Furthermore, the construction and bolting must be such as not to cause short circuits even if protective materials should fail. It is therefore preferred that all these elements be constructed of nonconducting materials rather than of coated metals. The fluorocarbons, the higher density polyolefins, some of the polyesters and in the case of materials facing only the denuder, the epoxies ae suitable materials. The current leads 12, the inner lip of 2 and the outer lip of 14 should be metallic and amalgam wettable, preferably iron or nickel. This is desirable to prevent the seepage of solution around the mercury in the case of the denuder rings and poor electrical contact in case of the leads 12.

The graphite fabric tape 11 serves as a very efficient denuding element, but graphite tubes around the leads 12 or other forms of graphite placed among these leads would also be suitable. However, it is preferred to use the graphite fabric wrapped around the leads 12 in such a manner as to form flow channels and thereby facilitate flow and mixing of the water and caustic, to avoid stratification and poor denuding. The water feed pipe 3 and the caustic and hydrogen pipe 15 are merely conventional piper or tubing which are either made of suitable insulating materials or carry suitable insulating joints.

The brine feed pipe 7 carries flow regulating device 6 to insure that the proper quantity of electrolyte reaches each element. This anolyte regulator 6 can be merely an orifice of suitable size or a control valve together with a flow sensing means. If a stack of these elements is fed from a common header, it is preferred to regulate the flow and, if desired, measure it, by means of a flow regulating device system designed to feed a constant proportion of the total flow to a number of vertically disposed vessels.

The flow of the individual electrolytic units should be uniform in spite of the different hydrostatic heads existing up the cell stack. This can be achieved by various distribution means such as individual feed pots fed on a time cycle together with flow-regulating orifices.

A preferred method of maintaining controlled and substantially equal volume flow of brine in each of the brine streams despite the differences in hydraulic pressures is to deliver each stream vertically upward in a tube with tapered bore. In this tube is a rotor, or float, which is suspended in the moving stream. The gravitational force on the rotor (less the buoyancy) is then balanced by an equal and opposite force exerted on the rotor by the moving stream. This force is independent of the stream flow rate and it is equal to the pressure differential times the maximum transverse section area of the rotor. The pressure differential is therefore also independent of the flow rate.

The float is an axially symmetrical body which is either a sphere or, preferably, a body having a center of gravity substantially below the cross section at maximum area. It is designed to be self centering in the moving stream and it may be described as plubm-bob-shaped. Its vertical position in the tapered tube is variable with the flow rate. When this position is measured on a linear scale as a measure of this flow, the device is known as a rotameter.

The parameters of this device are related as follows:

$$S_f(\Delta P) = v_f(d_f - d) \quad (1)$$

$$q/S = C\left[\frac{2gv_f(d_f - d)}{S_f d}\right]^{1/2} \quad (2)$$

where:

$\Delta P$ is the pressure differential;
$S_f$ is the maximum cross-sectional area of the float;
$v_f$ is the volume of the float;
$d_f$ is the density of the float;
$d$ is the density of the fluid;
$C$ is the orifice constant;
$g$ is the gravitational constant;
$S$ is the area of the annular space between the float and the tube wall at the maximum cross section; and
$q$ is the volume rate of flow.

These equations indicate that the pressure differential, $\Delta P$, which is imposed on the stream may be controlled by selection of the float parameter, $v_f(d_f - d)/S_f$, i.e. by suitable selection of the float geometry and apparent density, which together are referred to as the specific weight.

This invention is utilized for the purpose of maintaining an equal flow in the several streams as follows. The several streams may be designated numerically by 1, 2, 3, . . . n, and the hydrostatic pressures may be designated $p_1, p_2, p_3, \ldots p_n$, where the subscripts denote the stream numbers. The float parameter, as indicated above, in the float of each stream is adjusted so that the pressure differentials $\Delta P_1, \Delta P_2, \Delta P_3, \ldots \Delta P_n$ satisfy the condition:

$$p_1 + \Delta P_1 = p_2 + \Delta P_2 = p_3 + \Delta P_3 = \ldots = p_n + \Delta P_n$$

With adjustment of the float parameters as indicated above, the flow distribution remains equalized regardless of the total brine flow to the system.

In the foregoing description of this aspect of the present invention the flow of brine in the several streams is equalized and the flow in the several tubes is upward against the downward force at a float which is heavier than the fluid. It is possible however to utilize this invention to maintain the proportionality of flow at streams which are not equal by the use of floats suitably proportioned and weighted. A means to adjust the ratio of flow between streams, such as a valve in each stream, may be used in conjunction with the float control means whereby the ratio of flow between the streams (i.e. as set by a valve) is maintained regardless of total flow from header. It is also within the scope of this invention to utilize a float which is lower than the fluid in mean specific gravity. For this case the flow of fluid in the tapered tube is downward; the taper at the tube is expanding downward and the center of gravity of the float is above the cross section at maximum area.

There is the additional advantage that in this flow control system, the vertical position of the float is related to the annular area S and the volume flow q, assuming that all of the parameters on the right hand side of equation (2) remain constant. By varying the upstream pressure $P_1$ at the common manifold it is possible to obtain a proportional change in flow rate of the liquid stream to each cell while maintaining the differentials of hydrostatic pressure. It is a matter of great advantage in chlorine-caustic production to be able to control the solution flow to the individual cells proportionately by means of a control in a common manifold. This is for the reason that flexibility in production is essential to meet fluctuations in demand without providing very large storage facilities. If desired, these flow-balancing devices can be used as sensors of flow information when coupled with a capacitative or inductive position sensing means.

This flow control system is also of value in systems other than the chlorine cell disclosed herein. This type of flow control has general applicability to any system of multiple feeds from a common header where it is desired to maintain equal or proportionate flow between the multiple feed streams despite different upstream pressures.

The membrane A is shown as a planar film, but it is preferred to have an extended surface with corrugations or dimples extending up into the mercury, to extend the interface between it and the mercury. This reduces the electric resistance of the interface and of the membrane itself, and reduces the quantity of mercury in the system. The hydrostatic head to be provided by 18 should preferably be at least two inches of water column above the required for hydraulic balance. The anolyte pipes should also be designed to insulate electrically. Of course, some or all of the pipes attached to the cell could be replaced by passages within the cell structure.

Figure 2:
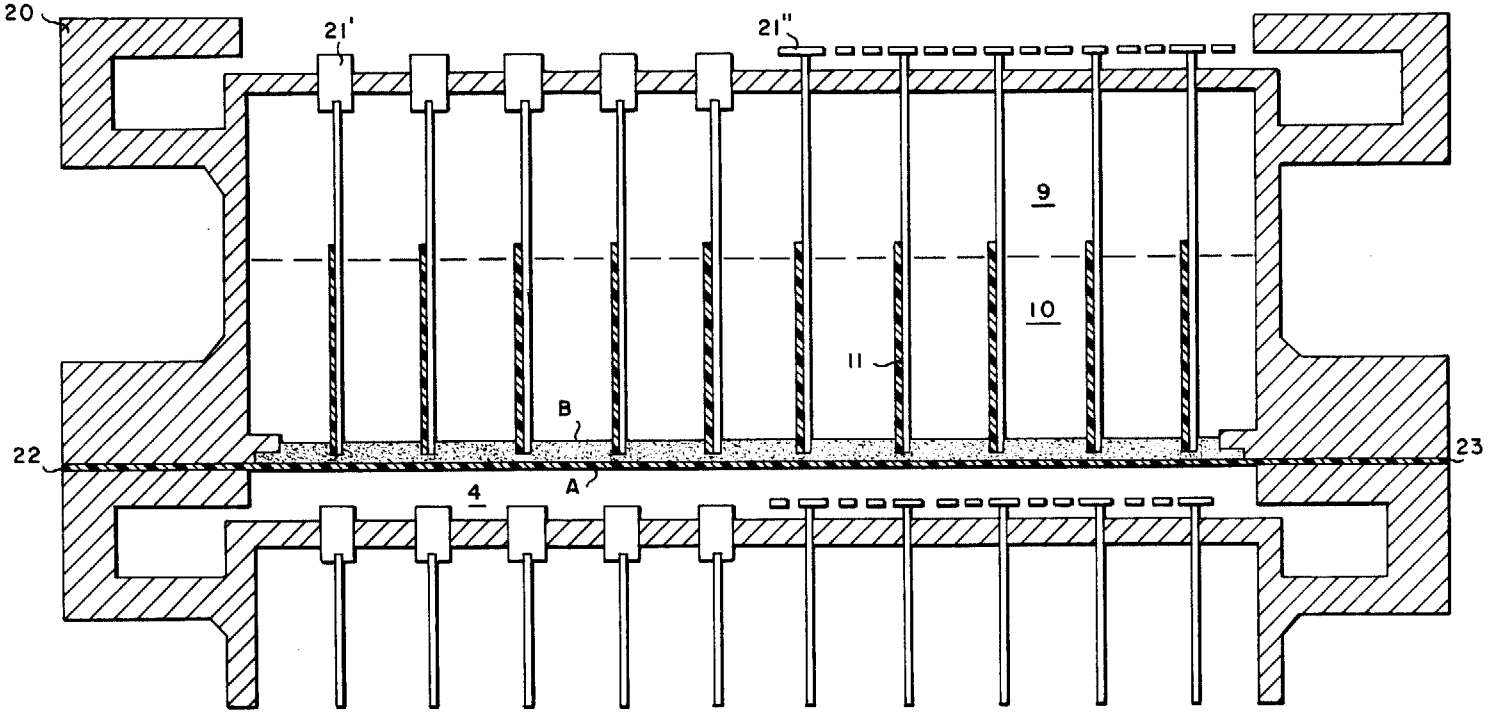
FIG. 2 is a partial section of a single element of a cell using a composite membrane, an anode (shown in the alternative forms of a perforated anode and a button anode), and graphite fabric in the denuder, intended to produce liquid chlorine under pressure.

Referring to FIG. 2, 20 is the cell housing, 21 is an anode and 22 and 23 are gaskets. All other elements of the cell described in FIG. 2 have the function of similar elements in FIG. 1. The anode 21 together with the current leads fulfill the same function as the anode 8 and the current leads 12 of FIG. 1, but facilitate run-off of liquid chlorine.

Two alternative anode constructions are shown in FIG. 2. On the left hand side the top of the current leads 21' are enlarged to form a button. This results in an anode that consists of a multiplicity of small pieces with channels between them for the run-off of the liquid chlorine. It is obvious that more than one lead can be connected to a single button in this manner and that the lead could be run through the top of the cell housing and the button placed entirely on top of the cell housing rather than having the button run through the top of the cell housing. This construction has the advantage that it lends itself to molding techniques, to wire and screw machines metal working techniques and permits the use of brittle anode materials that cannot readily be fabricated to cover a large surface in a thin section. In this manner a choice of materials is available and the current lead and the button can be one material or two quite different materials.

The anode design shown on the right hand side, wherein the anode is a perforated sheet 21'', lends itself to a different set of fabrication techniques. Perforated sheet, screens or expanded metal can be electrically connected to the current leads, either by running each current lead through the top of the cell housing or by joining several current leads to each other within the denuder compartment and bringing only one single connection from such a bundle of current leads to the anode sheet. By positioning the anode sheet somewhat above the top of the cell housing, space for liquid chlorine is provided.

The top face of either the buttons or the anode sheet must have a configuration such that liquid chlorine does not blanket it but tends to run off onto the top of the cell housing. If found desirable for corrosion resistance, the top of the cell housing can be protected by a layer of fluorocarbon held in place by shoulders on the leads or buttons.

The gaskets 22 and 23 seal the polymeric membrane to the cell housings and adjacent housings to each other. When using perfluorsulphonic acid polymers as a membrane, it is possible to seal this material to other fluorocarbons or to leave its edge in the sulphonyl fluoride form and to build up gasket structures in this manner. Similarly, this material, or its sulphonyl fluoride form can be used as is, or attached to fluorocarbon linings of other cell components, thereby leading to a variety of means of attachment and corrosion protection.

The bustle construction of FIG. 2 is somewhat different from the bustle construction of FIG. 1. This is due to the fact that the cell of FIG. 1 is intended to produce chlorine dissolved under pressure while the cell in FIG. 2 is designed to produce liquid chlorine which should drain freely through the perforations or channels in the anode along the top of the cell housing and into the inner bustle structure.

Figure 3:
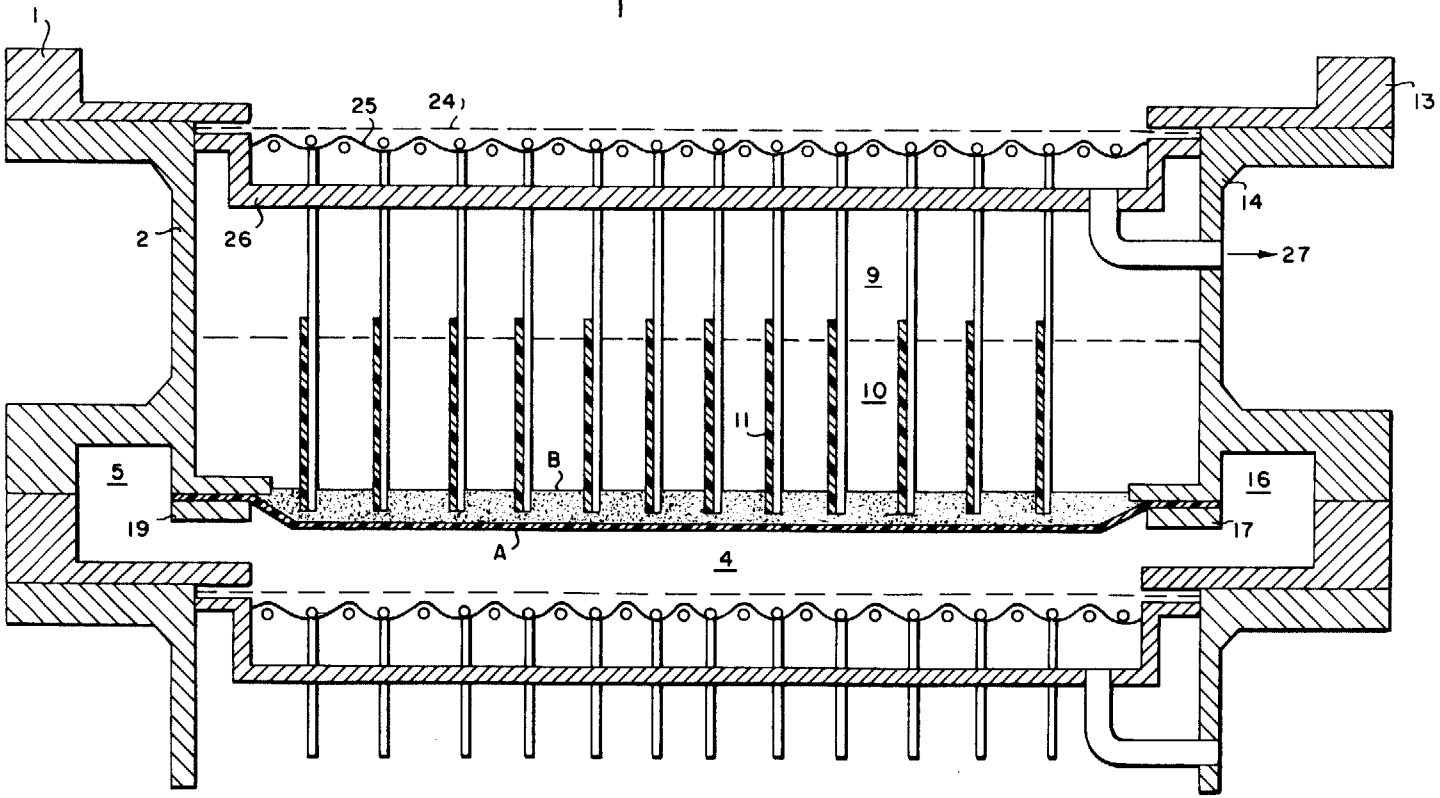
FIG. 3 is a partial section of a single element of a cell using a composite membrane and a drained anode compartment using a screen anode, and graphite fabric in the denuder, intended to electrolyze sodium sulphate.

Referring to FIG. 3, 24 is a diaphragm, 25 is an anode screen, 26 is an anode pan and 27 is an anolyte and anode gas outlet.

The cell of FIG. 3 is essentially the same as the cell in FIG. 1 with a fundamentally different anode construction. Using the electrolysis of sodium sulphate solution to produce caustic soda, sulfuric acid, hydrogen and oxygen as an example, it is obvious that the anode gas, oxygen, is neither soluble nor liquefiable under any practical conditions within a cell. Therefore, to carry on such an electrolysis, one can either accept the disadvantages of gas bubbles in the anolyte, which requires a large anolyte flow to sweep the gas bubbles from the cell but still results in a higher cell resistance, or one can operate a cell with a composite membrane at the cathode and a diaphragm protected drained anode, leaving the intervening electrolyte substantially free of gas bubbles. The electrolyte can either percolate completely through the anode diaphragm or can be circulated partially through the cell while part of it is permitted to flow through the diaphragm. This can be controlled by choosing a diaphragm of proper resistance to flow and by controlling the differential pressure between the main electrolyte flow and the gas phase in the anode pan by means well known in the art.

The diaphragm can be replaced by an anion-permeable membrane or an anion-permselective membrane, so that, in the case of sodium sulphate electrolysis, the anolyte will contain mostly sulphuric acid with a minimum of sodium sulphate which would drain at the anode, rather than a mixture of sulphuric acid and sodium sulphate. The sodium sulphate circulating stream can then be merely resaturated without the need of an external crystallization step to separate the sodium sulphate from the sulphuric acid. Since one of the main applications for sodium sulphate electrolysis is the recovery of rayon spin baths, such a crystallization can be carried out by circulating the solution from the cell through the spin bath recovery.

A cell of this nature can also be used for the electrolysis of sodium chloride by choosing suitable diaphragm and anode materials, in which event the cell can be operated at nearly atmosphereic pressure.

Although FIG. 3 shows a screen anode, other draining forms of anodes can be employed as well, thus permitting the use of materials such as lead-silver-alloy, magnetite and others.

Figure 4:
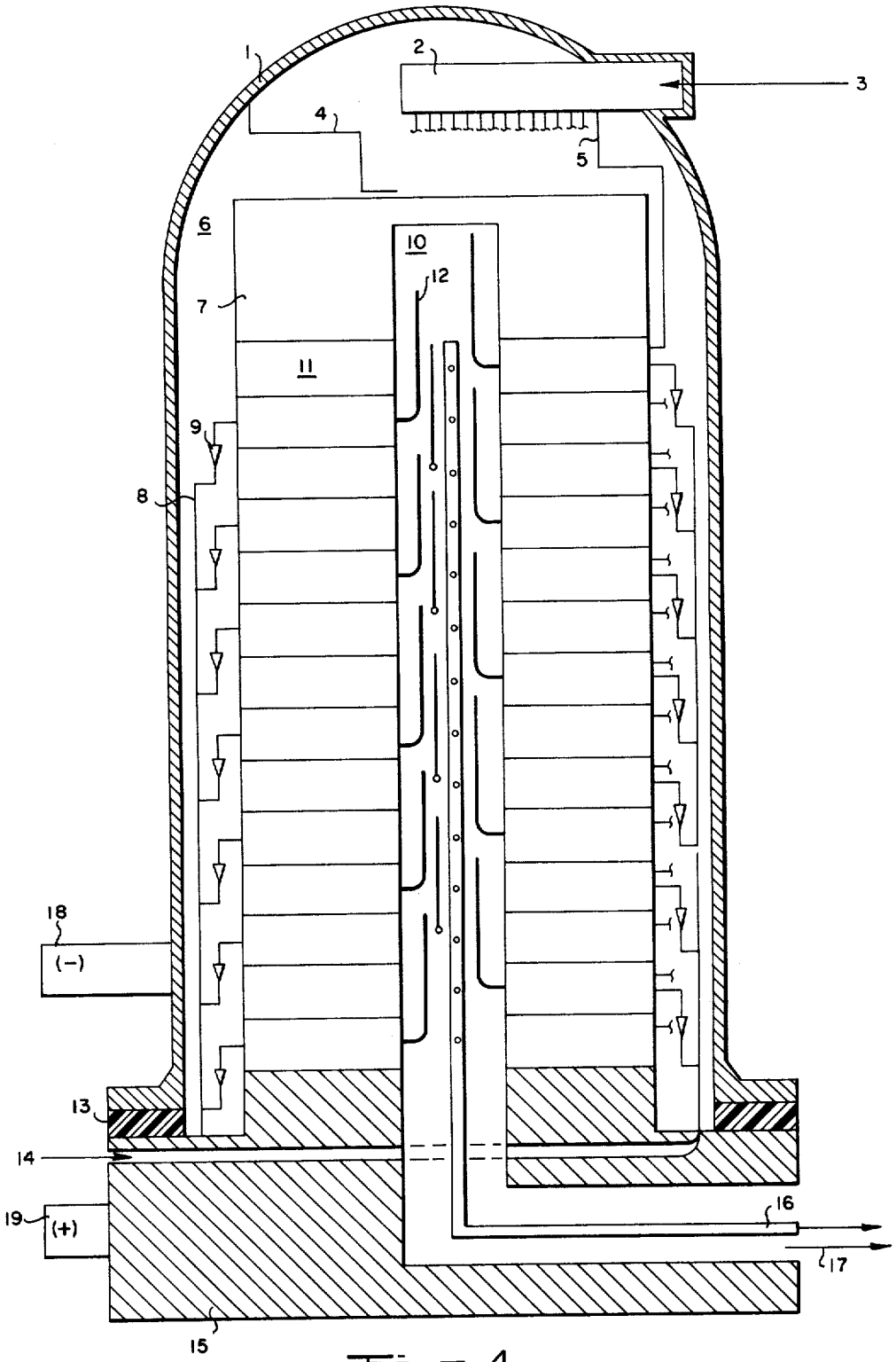
FIG. 4 shows a section through a stack of cell elements inside a pressure containing shell intended to produce chlorine under pressure.

Referring to FIG. 4, 1 is a pressure shell, 2 is a caustic or water distributor, 3 is a caustic or water feed, 4 is a flexible cathode bus, 5 is a caustic or water feed tube, 6 is an insulating pressure fluid, 7 is a cathode end cap, 8 is an anolyte feed header, 9 is an anolyte regulator, 10 is an anolyte disengagement core, 11 is a cell element, 12 is an anolyte overflow pipe, 13 is an insulating ring, 14 is an anolyte feed, 15 is an anode end cap, 16 is the caustic and hydrogen outlet, 17 is the anolyte and chlorine outlet, 18 is the cathodic rectifier bus connection and 19 is the anodic rectifier bus connection.

This figure shows a schematic section of a stack of cell elements producing chlorine as liquid or dissolved gas. The bottom of the stack is the end anode which also carries most if not all piping connections, since the water or caustic connection 3 could also be carried in the base. This base is also connected to the positive side of the rectifier. Mounted over the stack and fastened in a pressure tight manner to the base is pressure shell 1, and the space between the pressure shell and the cell stack is filled with insulating pressure fluid 6. On top of the cell stack is the cathode end cap 7. This end cap is connected by means of flexible bus work to the shell 1 which acts as the vertical bus leading the negative current from the rectifier which is connected at its bottom to the top of the cell stack. On top of the cell stack is also located the water or caustic distributor 2 which feeds the denuders of each element. The liquid volume in each denuder is relatively large so that a discontinuous feed is acceptable, provided the average feed volume is accurate. Therefore, measurement of the total feed 3 to the stack accompanied by accurate distribution by a device such as a rotating valve, small gang type plunger pumps, and the like, is suitable. The distribution device should be on top of the stack so that the individual feed tubes drain empty into the denuders to prevent current leakage through the set of feed tubes 5. If the insulating fluid 6 provides perfect insulation, the pressure shell except for the insulating ring 13 can be bare metal. However, the danger of leaks from the cell stack, in spite of pressure balance controls between the cell stack and the fluid 6, is ever present and a major short can develop. Therefore, it is preferred that the inner surface of the pressure shell 1 be lined with a suitable insulating material which can be rubber or any other plastic material compatible with the fluid 6 and the operating temperature. In addition, the area at the bottom of the shell and the top of the anode end cap 15 should be shrouded in leak tight combination with ring 13 as the total differential voltage of the stack exists at that point.

The shell configuration described above assumes that the main output from the rectifier or other direct current source is at or near ground level. Should this not be the case, the insulating joint in the shell can be anywhere along the height of the shell and the current connections would then be placed on either side of the insulating joint.

Figure 5:
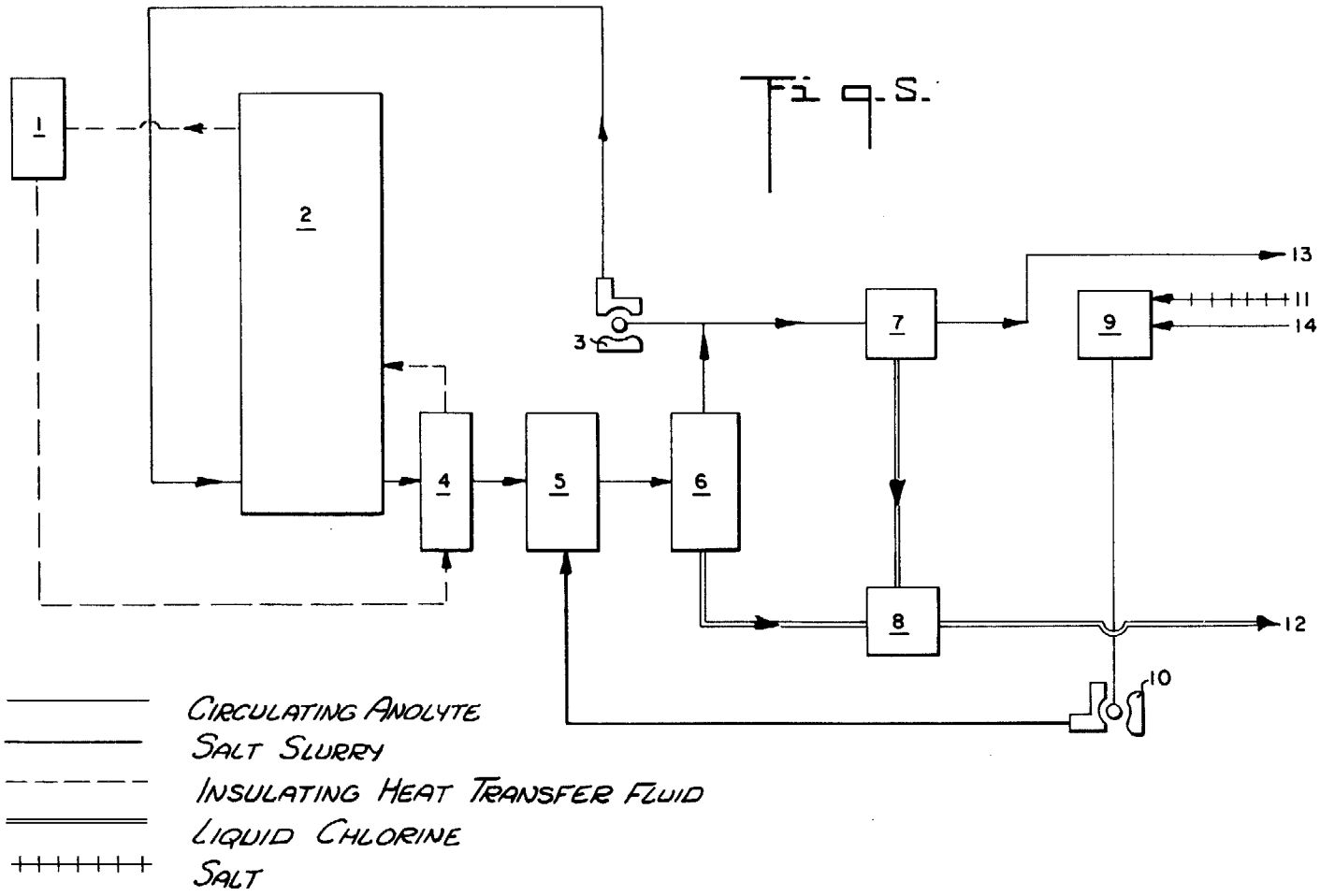
FIG. 5 shows a flow sheet of the brine and chlorine system for a cell stack composed of cells using composite membranes to produce liquid chlorine under pressure.

Referring to FIG. 5, 1 is a cooler or heat recovery unit, 2 is a cell stack, 3 is an anolyte circulation pump, 4 is a spent anolyte cooler, 5 is a resaturator, 6 is a chlorine decanter, 7 is a dechlorination system, 8 is a chlorine drying system, 9 is a slurry tank, 10 is a slurry pump, 11 is salt feed, 12 is chlorine product, 13 is an anloyte bleed stream, and 14 is a purified anolyte bleed return stream.

FIG. 5 is a schematic flow sheet for the brine and chlorine systems surrounding one or several cell stacks producing liquid chlorine directly in the cells. The operation of the process depicted in this flow sheet is obvous therefrom to one skilled in the art. Briefly, it comprises the following. The spent anolyte passes from the cell 2 into the heat exchanger 4 where its temperature is reduced. The cooled anolyte then passes into resaturator 5 where its salt content is increased. The anolyte then passes into the chlorine decanter 6 from which most of the anolyte is recirculated through pump 3 back into the cell 2. Some of the anolyte from chlorine decanter 6 passes into the dechlorinator 7 from which it is discharged as stream 13. Purified anolyte, stream 14 and salt 11 are fed into a slurry tank 9 and passed by slurry pump 10 into the resaturator 5. The chlorine removed from the chlorine decanter 6 and dechlorinator 7 are passed through the chlorine dryer 8 and discharged as stream 12. The heat transfer fluid from the cell 2 passes through heat exchanger 1 and the spent anolyte cooler 4, from which it is then passed back into the cell stack 2.

The theoretical decomposition voltage of sodium chloride is about 2.3, and a stack operates commercially at a voltage of about 2 volts above this theoretical voltage per element. This excess voltage appears as heat and corresponds to a rate of about 60 KW per daily ton of chlorine produced. Most of this heat will appear as a temperature rise in the circulating electrolyte and in the caustic produced and some will result in a temperature rise of the insulating fluid 6 of FIG. 4. This heat must be removed. This can be accomplished by simple heat exchange and the heat rejected to air or water. However, if an adequate difference in temperature exists between operating temperature and the heat sink, a substantial amount of the electrical energy above that theoretically required can be recovered for power generation, proces heat, water desalination and the like. For power generation it would be beneficial to use a fluid such as Freon with boiling characteristics of temperature and pressure close to the conditions of the cell stack. This then makes the coolers and the cell stack into a boiler. The boiling insulating fluid can be used to drive a turbine after which it can be condensed and returned to the coolers 4. Otherwise, distilled water is quite satisfactory as the insulating fluid.

Liquid chlorine has an unusually large coefficient of thermal expansion. At room temperature liquid chlorine is much heavier than the anolyte but at higher temperatures the specific gravity of chlorine approaches or becomes less than that of the anolyte.

The chlorine must therefore be separated from the anolyte either by decantation beneath the anolyte or removed at the top of the anolyte. The temperature conditions in the decanter, by control if necessary, should ensure that there is an adequate gravity difference for separation. Furthermore, the peculiar characteristics of chlorine indicate that the cell configuration and operation must be such that they provide against chlorine blanketing of the membrane when the chlorine is lighter than the electrolyte and against chlorine flooding of the anode when chlorine is heavier than the electrolyte.

The dechlorination system 7 shown in FIG. 5 is a dechlorination system that permits bleeding of a relatively small portion of the recirculating anolyte for two purposes, maintaining impurities at an acceptable level and slurrying the salt feed to the system. The rate of circulation of the anolyte may be between about 5 and 10 gallons per minute per daily ton of chlorine while the bleed stream 15 about 0.3 to 0.5 gallons per minute. The dechlorination under pressure is accomplished by heating the bleed stream with suitable heat exchange means to recover heat. If a small use for gaseous chlorine, such as the manufacture of hypochlorite or hydrochloric acid is available, the dechlorination can be accomplished by simply flashing the bleed stream to atmospheric pressure and then dechlorinating by air blowing or vacuum in the conventional manner.

Figure 6:
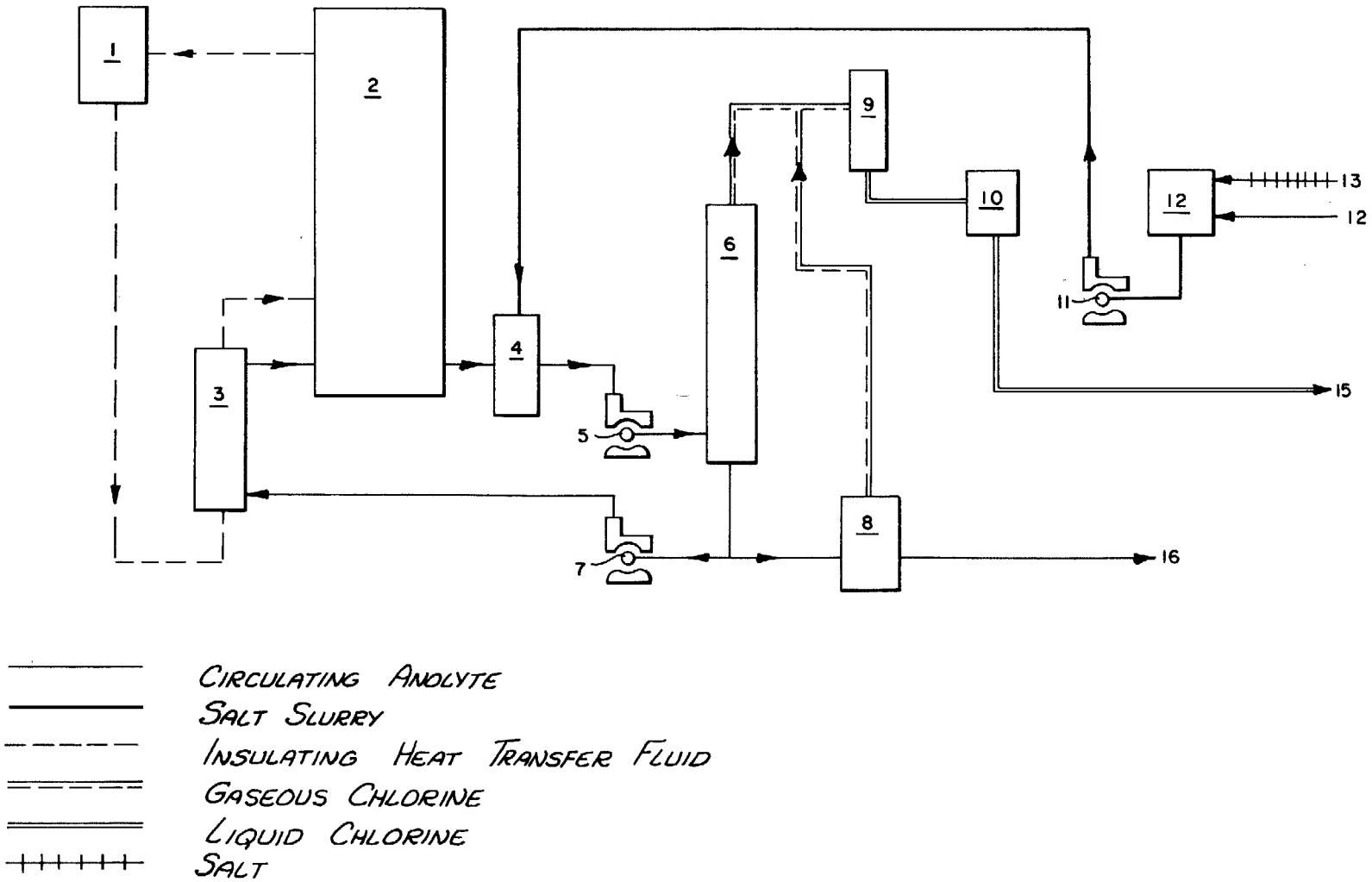
FIG. 6 shows a flow sheet of the brine and chlorine system and a cell stack composed of cells using composite membranes to produce chlorine dissolved in brine under pressure.

Referring to FIG. 6, 1 is a cooler or heat recovery unit, 2 is a cell stack, 3 is an anolyte cooler, 4 is a resaturator, 5 is an expansion engine, 6 is a chlorine flash separator, 7 is an anolyte circulation pump, 8 is a dechlorination system, 9 is a chlorine condenser, 10 is a chlorine drying system, 11 is a slurry pump, 12 is a slurry tank, 13 is salt feed, 14 is a purified anolyte bleed return stream, 15 is chlorine product, and 16 is an anolyte bleed stream.

The operation of this arrangement can be briefly summarized as follows. The spent anolyte passes into resaturator 4 and then into expansion engine 5 which is driven by the anolyte as it flows to the chlorine flash separator 6. The major portion of the anolyte passes from the separator 6 into the anolyte recirculation pump 7 which pumps the anolyte into the anolyte cooler 3 and back into the cell stack 2. A minor portion of the separated anolyte passes into the dechlorination system 8 from which it is bled from the system at stream 16. The chlorine from the flash separator 6 and from the dechlorination system 8 passes into a chlorine condenser 9, a chlorine drying system 10 and then passes out as product stream 15. Purified anolyte 14 and salt 13 are passed into a slurry tank 12 and directed by slurry pump 11 into the resaturator 4. An electrically-insulating heat-transfer fluid is pumped through the cell stack 2 and into a heat transfer unit 1 from which it is passed through the anolyte cooler and back into the cell stack.

This flow sheet therefore is similar to the flow sheet of FIG. 5, except that it is intended to provide a means of operation for a cell where the entire chlorine production leaves the cell as a dissolved gas. To obtain the chlorine product, the pressure of the spent anolyte is reduced from cell operating pressure which results in the evolution of gaseous chlorine in relatively direct relationship to the ratio of operating pressure and pressure maintained in the chlorine flash separator 6. Since the chlorine separated in 6 is hot and moist, and under some pressure, it is condensable by cooling. It is preferred to flash at pressures above 100 psi to be able to take advantage of normally available cooling water.

Since very large quantities of anolyte must be pumped from flash pressure to operating pressure, resulting in considerable energy use, it is preferred to recover a large proportion of this energy by flashing the spent anolyte and produced chlorine through a type of expansion engine 5.

The flow sheets of FIGS. 5 and 6 indicate the production of a wet, liquid chlorine. This liquid chlorine can be washed free of adherent salt if necessary and then dried. In normal commercial practice, it is essential that the chlorine be dried so that its moisture content is in equilibrium with sulphuric acid of about 95% at 60° F, as otherwise the steel equipment in which liquid chlorine is conventionally piped and stored will corrode.

The salt feed to the system will usually have been purified and prepared on the site. The salt feed should preferably be relatively fine to insure rapid dissolution, as otherwise salt crystals might enter the cell and erode the membranes.

Figure 7:
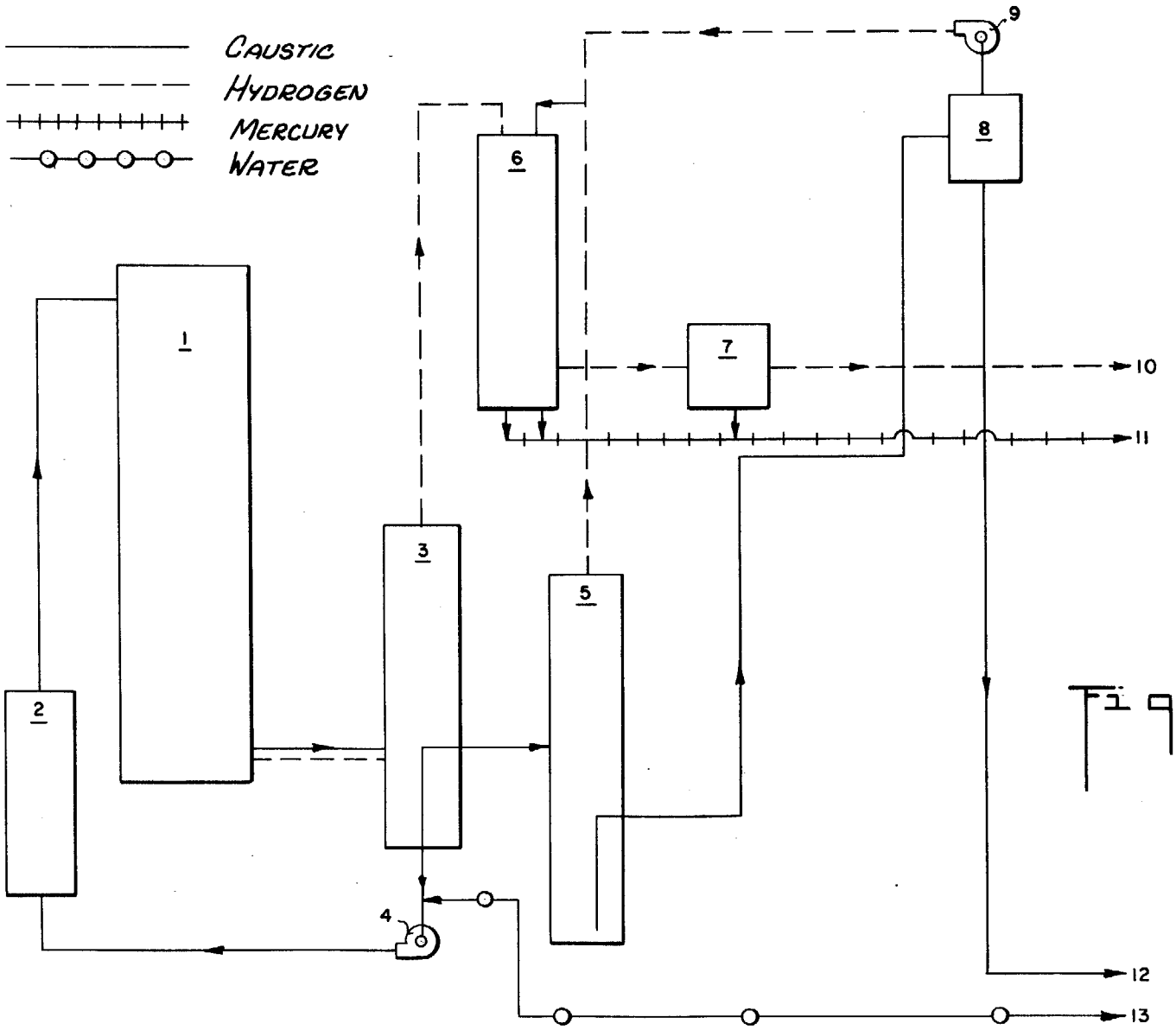
FIG. 7 shows a flow sheet of the water, caustic and hydrogen systems for a cell stack in which the caustic is cooled by recirculation.

Referring to FIG. 7, 1 is a cell stack, 2 is a caustic cooler, possibly combined with a heat recovery system (not shown), 3 is a caustic separator, 4 is a caustic circulation pump, 5 is a caustic separator flash tank, 6 is a hydrogen cooler, 7 is a mercury removal system, 8 is a caustic vacuum degassing vessel, 9 is a vacuum pump, 10 is a hydrogen stream, 11 is a recovered mercury stream, 12 is a caustic stream and 13 is a water stream.

Hydrogen and caustic are withdrawn from the cell stack together and separated in 3. Since hydrogen is only very sparingly soluble in caustic, most of the hydrogen will separate as a hot gas under pressure. After cooling this hot gas in 6, the mercury content of the cold gas, which is already very low because the hydrogen is under pressure, is lowered further and the condensed mercury can be recovered. The very slight quantity of mercury vapor present in cold hydrogen under pressure can be further removed in 7 by known techniques such as chlorine water scrubbing, adsorption and the like. Because the system operates in a completely encapsulated apparatus as distinct from the conventional mercury cell and because the mercury content of the hydrogen is inversely proportional to the pressure at which the hydrogen is generated, the mercury pollution that occurs or must be dealt with is minimized by a factor of ten or more. The hydrogen issuing at 10 would then no longer be of ecological consequence because of the efficient removal of mercury. It should also be noted that the chlorine is produced without the presence of uncondensable gas and there is, therefore, no sniff gas to be vented or treated.

After being separated in 3, most of the caustic would be recycled for cooling through 2. This cooling system together with the cooling system shown in FIGS. 5 and 6 can be operated in various ways depending upon the results desired. It can either be run simply to cool the caustic, thus removing the heat content of the caustic stream, or the caustic heat removal can be so managed that the caustic stream is at a higher temperature than the brine stream, thus enhancing the possibility for heat recovery as distinct from simple cooling. The net increase in caustic in the system, that is the net caustic production, would be permitted to flow from 3 to 5 where it would be expanded to nearly atmospheric pressure. Dissolved hydrogen as well as small hydrogen bubbles would leave the caustic at that point. Depending upon the configuration of the system, the hydrogen leaving in 5 may be free of mercury in which event it need not be subjected to any treatment other than the removal of caustic droplets, or it may contain some mercury contamination, in which event it can be treated in parallel to the main hydrogen stream issuing from 3. Hydrogen has a tendency to remain suspended as very tiny bubles is caustic when hydrogen pressure is relieved and it may therefore be desirable to flash the remnant hydrogen bubbles from the caustic by vacuum in 8. The small amount of hyrogen that would be pumped from the caustic at this point can be joined to the hydrogen stream from 5 and treated as necessary. The caustic coming from 8 can then be sent directly to storage without fear of hydrogen explosions in the storage tanks.

The system is operable over a wide range of temperatures and pressures which will produce liquid or dissolved chlorine, in accordance with their physical characteristics. Within the range of operable conditions, the selection of a particular pressure and temperature is determined by balancing the economic factors by well-known optimization techniques. Examples of temperature and pressure range for liquid chlorine production are from about 100 to 1000 psia at from about 60° to 270° F, or 300 to 650 psia at from 150° to 225° F.

In accordance with economic considerations the process would generally be operated at a temperature above the temperature of an available heat sink. In common industrial practice, this would be 80° F. This means that a cell producing liquid chlorine would be operated at pressures aboe 1000 psi and that the flash pressure in the case of a system where the chlorine is entirely produced as a dissolved gas would also be no lower than 100 psi to permit liquefaction of the chlorine without mechanical refrigeration.

The upper pressure/temperature limits are again substantially a matter of economics. The upper limit of course for liquid chlorine is its critical temperature. At very high pressures the equipment becomes extremely expensive and therefore the process would not normally be operated above a pressure of 1000 psi. The operating temperatures which are possible within these pressure ranges can be determined from well-known data. The possibilities of heat recovery from the system are enhanced by operating at high temperatures so as to have a temperature difference between the brine and caustic temperatures and the heat sink temperature respectively. With liquid chlorine production directly in the cell, a major consideration is the boiling point curve for liquid chlorine. In the case of dissolved chlorine production in the cell, the solubility of chlorine decreases with increasing salt concentration and temperature and increases with increasing pressure. Thus, the greater the pressure difference between the cell and the flash separator, the more chlorine per unit of brine flow will be produced per pass. The higher the salt concentration, the lower will be the chlorine production per pass of brine. The higher the cell operating temperature, the less chlorine will be dissolved in the brine but the more heat can be recovered from it. Standard optimization techniques to gether with known data concerning the boiling point and solubility of chlorine would be used to determine operating conditions for any particular case.

All conventional chlorine cells must be housed as they cannot be practically operated out of doors. The cells of this invention can be operated out of doors in almost any climate and the cost of building avoided. The cell design of the invention requires neither bus work from element to element nor distributing bus work at each element resulting in the total absence of copper or aluminum bus bars around the cells. This not only saves capital costs but avoids one of the main maintenance costs of the average chlorine plant.

The foregoing descriptions of the invention have been directed to the electrolysis of sodium chloride and sodium sulphate, producing caustic soda and hydrogen in each case. This is however not intended to be a limiting feature of the invention. Solutions containing other ions, particularly the corresponding potassium ion solutions, can be electrolyzed in a similar manner. The invention set forth herein is generally applicable for compounds that are capable of being electrolyzed in conventional mercury cathode cells. It is also useful to carry out other known electrolysis processes of solutions containing alkali metal ions. Of course anloytes (or impurities or interfering ions therein) and denuding media known to interfere with the proper functioning of the electrolytic process should be avoided. Furthermore, the denuder can be used, at times without denuding graphite, for the production of sodium sulphide by using sodium polysulphide as the denuding medium, for the production of sodium hydrosulphite by using sulphur dioxide solution as the denuding medium, for the production of alcoholates, for various organic reductions, dimerizations and similar reactions.

Also, by careful control of current efficiency ratios to avoid the oxidization of the metal component of the composite membrane, it is possible to use this metal component as a bipolar electrode, thus carrying out a further reaction step between a final electrode within the denuder chamber and the anionic side of the now bipolar metal component of the composite membrane. An example of such a reaction would be the production of sodium. Furthermore, although the mercury layer is always described as stationary, this does not exclude the alternative of circulating mercury from the composite membrane.

EXAMPLES

The following examples were conducted in cells containing a platinized titanium anode facing a composite membrane with substantially saturated brine flowing between the anode and the composite membrane. The chlorine produced was withdrawn from the cell with the brine stream. The composite membrane comprised "Nafion" perfluorosulphonic acid membrane made from a copolymer of tetrafluoro ethylene and a vinyl ether of the formula $FSO_2CF_2\ CF_2OCF(CF_3)CF_2OCF{=}CF_2$ through conventional thermoplastic techniques followed by conversion of the pendant sulfonyl fluoride group to the acid from the resulting copolymer having an equivalent weight in the range of 950 to 1350 (made by E.I. du Pont de Nemours & Co., Inc.), with a layer of mercury above it. The amount of mercury was sufficient to cover the polymeric membrane entirely, care being exercised that any corrugations or dimples in the polymeric membrane were also covered. The mercury of the composite membrane was in contact with graphite elements and water was passed over the mercury to produce caustic and hydrogen above the composite membrane. In all examples, by virtus of the swelling of the membrane either by means of solvent or by the electrolyte, its surface was extended into the mercury because the pressure on the brine was more than the weight of mercury and caustic above the membrane. The gross cell surface was approximately 1 square decimeter (about 2 inch × 8 inch). The flow of water through the denuder was varied so as to produce various concentrations of caustic from less than 10% to over 50%, and no effect on cell operation was observed as a result.

EXAMPLE 1

A cell was operated at atmospheric pressure with the polymeric membrane having a 2 mil nominal thickness. The brine flow rate was approximately 4.2 gallons per minute. The cell voltage was 4.9 at 50 amperes and was 6.6 volts at 80 amperes. The brine flow rate was increased to 6.4 gallons per minute to improve the sweeping of gas from the cell and the voltage dropped to 6.0 at 80 amperes. The temperature was 190 to 205° F.

EXAMPLE 2

The same cell was operated with a membrane that had first been soaked in hydrochloric acid and then in a saturated aqueous solution of mercuric chloride at 100° C for 24 hours. The mercury in the membrane was then reduced to metallic mercury in situ by means of hydroxylamine and the cell operated under the same conditions as before using a brine flow rate of 6.4 gallons per minute. The cell voltage was 5.6 at 80 amperes and 4.6 volts at 50 amperes.

EXAMPLE 3

The same cell was operated under the same conditions but the membrane was swollen with glycol prior to the mercury impregnation described in Example 2. The cross cell voltage was 0.2 to 0.3 volts lower at 80 amperes than the voltage without the use of glycol-treated membrane.

EXAMPLE 4

A cell with a 3.5 mil nominal thickness polymeric membrane was operated at 75° F and 450 psi pressure with a brine flow of 50 cc per minute. The anode was grooved to permit liquid chlorine to run off. The elements above the mercury consisted of nickel pins of 1/16 inches diameter on ¼inches centers with a graphite fabric around and between the pins; the graphite and nickel being in contact with the mercury. At first, at about 10 amperes and a cell voltage of 3.64, chlorine dissolved in brine appeared in a sight glass at the discharge of the cell. As the amperage was raised to 50 amperes the cell voltage increased and then fell as liquid chlorine appeared and the cell voltage stabilized at 5.1. The liquid chlorine appeared as a separate phase in the sight glass together with brine containing dissolved chlorine. Liquid chlorine appeared as the amperage was raised since the production of chlorine exceeded its solubility in brine. At a higher temperature and with a thinner polymeric membrane a lower cell voltage could be obtained. The sight glass was arranged so that the brine and liquid chlorine entered through a dip tube at the top. The sight glass also had an overflow above the bottom edge of the dip tube. This arrangement resulted, at these operating temperatures, in settling of the liquid chlorine at the bottom of the sight glass and an overflow of the brine from the top of the sight glass. Thus the sight glass functioned as a decanter. From the overflow, the brine containing dissolved chlorine flowed to a receiving vessel. Subsequently the pressure in the receiving vessel was reduced and the dissolved chlorine bubbled from the brine. Hydrogen and caustic flowed from the cell into a vessel where the hydrogen and caustic separated. The entire system had initially been padded with nitrogen and the hydrogen was subsequently vented together with the nitrogen pad.

This invention has been described in terms of specific embodiments set forth in detail. Alternative embodiments will be apparent to those skilled in the art in view of this disclosure, and accordingly such modifications are to be contemplated within the spirit of the invention as disclosed and claimed herein.

I claim:

1. An electrolytic cell having an anode and a composite membrane comprising a polymeric membrane facing said anode and a cathodic layer of metal permeable to alkali metal ions in intimate contact with said polymeric membrane at its surface facing away from said anode, said polymeric membrane horizontally positioned to support said metal thereon, said anode and composite membrane being spaced apart to form an electrolyte chamber.

2. The cell of claim 1 wherein said polymeric membrane is a perfluorocarbon polymer having pendant sulfonic groups.

3. The cell of claim 2 wherein said metal is mercury.

4. The cell of claim 2 wherein said polymer contains mercury deposited therein.

5. The cell of claim 2 wherein said polymer has been treated with a swelling agent.

6. The cell of claim 1 wherein the configuration of said anode is adapted to provide liquid run-off space.

7. The cell of claim 6 wherein said anode comprises a screen, or a multitude of separated discrete elements protruding from a surface.

8. The cell of claim 1 comprising means to pressurize said cell to between 100–1000 psi.

9. The cell of claim 8 wherein said polymeric membrane is deformed to protrude upwardly in the areas between said current leads.

10. The cell of claim 8 wherein said current leads have surrounding graphite fabric at least in the area of contact with said metal.

11. A series of vertically stacked cells each having the configuration of the cell of claim 1 wherein said cells have current leads which electrically connect the anode of each cell with the cathodic layer of metal in the next adjacent cell.

12. The cell stack of claim 11 having a brine feed head conduit substantially vertically disposed along the cell elements of the cell stack, brine feed conduits connected to each cell element to communicate with said electrolyte chamber and said feed head conduit, flow control means in each brine feed conduit, and float means in each flow control means, wherein the sum of the specific weight of each float means and the respective hydrostatic head pressure in said feed head conduit at the level of the corresponding cell elements is the same, to provide substantially the same flow of brine to each cell element, wherein said specific weight equals $$V_f(d_f - d)/S_f,$$

where $V_f$ is the volume of said float, $d_f$ is the density of said float, $d$ is the density of the brine and $S_f$ is the maximum cross-sectional area of the float.

13. The cell of claim 1 comprising means to pressurize said cell to maintain the pressure in said electrolyte chamber to between 100–1000 psi.

14. The cell of claim 1 wherein said polymeric membrane is a copolymer of $FSO_2CF_2CF_2OCF(CF_3)OCF=CF_2$ with $F_2C=CF_2$, which has been treated to convert $-SO_2F$ groups to sulfonic groups.

15. The cell of claim 1 wherein said anode is a foraminous anode and comprising a diaphragm or a membrane between said composite membrane and said anode.

16. An electrolysis apparatus comprising a series of electrolytic cells, each electrolytic cell comprising an anode, a cathode wherein said cathode is the metallic layer of a composite membrane; said composite membrane having a polymeric membrane facing said anode, and a layer of metal permeable to alkali metal in intimate contact with said polymeric membrane at its surface facing away from said anode, said polymeric membrane horizontally positioned to support said metal thereon an anolyte chamber between said anode and cathode said cells of said series being stacked on top of each other in spaced apart relationship whereby the space between the anode of a first cell and the cathode of the next adjacent lower cell forms a chamber.

17. The apparatus of claim 16 wherein said series of cells is surrounded by a shell spaced apart from said cells to form a space between said shell and the exterior of said series of cells.

18. The apparatus of claim 17 wherein at least a portion of said shell is a conductor of electric current to said series of cells.

19. The apparatus of claim 18 wherein said shell is supported on a base member adjacent the anode of the lowermost cell and insulating means separate said shell from said base member.

20. The apparatus of claim 17 comprising an insulating fluid in said space.

21. The apparatus of claim 17 wherein the surface of said shell facing said cells is insulated.

22. The cell of claim 16 comprising means to pressurize said cell to between 100–1000 psi.

23. The cell of claim 16 comprising means to maintain a pressure within said cell of between 100–1000 psi.

24. A process for the electrolysis of an aqueous solution containing sodium and/or potassium ions in solution with anions of the mineral acids and/or of the organic acids and/or hydroxyl ions in an electrolytic cell comprising a foraminous anode, a composite membrane comprising a polymeric membrane facing said anode and a cathode layer of metal permeable to alkali metal ions in intimate contact with said polymeric membrane at its surface facing away from said anode, said polymeric membrane horizontally positioned to support said metal thereon and a membrane or a diaphragm between said anode and composite membrane comprising passing an electric current through said aqueous solution between said anode and cathode and withdrawing the anode product through said anode.

25. The process of claim 24 wherein said aqueous solution is of sodium sulphate.

* * * * *